United States Patent [19]

Mednis

[11] Patent Number: 4,640,423

[45] Date of Patent: Feb. 3, 1987

[54] MULTIPLE VARIABLE CONTAINER PACKAGE

[75] Inventor: Juris M. Mednis, Howell, N.J.

[73] Assignee: Universal Symetrics Corporation, Howell, N.J.

[21] Appl. No.: 721,195

[22] Filed: Apr. 9, 1985

[51] Int. Cl.[4] ..... B65D 21/02

[52] U.S. Cl. ..... 215/10; D9/375; 206/504; 206/509; 220/234; 220/236; 222/143; 446/124

[58] Field of Search ..... 220/23.4, 23.6, 23.83, 220/23.86; 215/10; 206/504, 509; D9/375; 222/143; 446/124

[56] References Cited

U.S. PATENT DOCUMENTS

| | | | |
|---|---|---|---|
| D. 267,701 | 1/1983 | Pardo | D9/375 |
| 2,115,692 | 5/1938 | Orme | 220/23.83 |
| 3,334,798 | 8/1967 | Pezely | 446/124 |
| 3,374,917 | 3/1968 | Troy | 215/10 |
| 3,391,824 | 7/1968 | Wiseman | 215/10 |
| 3,933,268 | 1/1976 | Buske | 206/504 |
| 4,235,343 | 11/1980 | Thompson | 215/10 |
| 4,489,839 | 12/1985 | Epperson | 222/143 |

FOREIGN PATENT DOCUMENTS

| | | | |
|---|---|---|---|
| 2402618 | 7/1975 | Fed. Rep. of Germany | 220/23.86 |
| 2299237 | 8/1976 | France | 215/10 |
| 255698 | 11/1927 | Italy | 220/23.4 |
| 215487 | 6/1941 | Switzerland | 220/23.86 |

*Primary Examiner*—George E. Lowrance
*Attorney, Agent, or Firm*—Angelo Notaro

[57] ABSTRACT

A container package comprises a plurality of individual containers which each have a hollow polygonal body from which an elongated hollow neck extends. Each hollow body has side walls, a bottom wall and a top shoulder wall. A recess is provided either in the bottom wall or one of the side walls for receiving the neck of an adjacent container in the package. The containers are mated together and form a polyhedron. The containers may have interior volumes which are different from each other so that the containers contain different amounts of materials or may have identical volumes but be shaped differently from each other. At least one of the recesses may also contain a secondary container which, together with a neck of another container, substantially fill the recess.

22 Claims, 16 Drawing Figures

MULTIPLE VARIABLE CONTAINER PACKAGE

BACKGROUND OF THE INVENTION

This invention relates in general to containers and, more particularly, to a new and useful container package which is composed of two or more individual hollow containers that are mated together and which have different interior volumes or exterior displacements or shapes.

Containers that have necks or spouts extending from a main body portion of the container to facilitate the discharge of material from the interior of the container are well known. Containers having elongated necks for aesthetic reasons or for a combination of aesthetic and functional reasons are also known. In cases where such containers are packaged in rectangular or square cartons, significant space is lost around the elongated necks. This empty space must at times be filled with packing material in order to reduce the possibility of damage to the containers during transit. Protection and support for such containers is usually provided by cardboard boxes and similar structures in which the containers are packed.

The association of two or more containers together in a multiple container unit is also known. Four and six packs are particularly popular in the beverage field.

It is also known to utilize the neck of a container to facilitate nesting or engagement of one container to another. See, for example, U.S. Pat. No. 4,489,839 which shows a container having a substantially cylindrical body portion with a recess and a cylindrical upstanding spout or neck. The neck of one container rests in the recess of another container for facilitating nesting of one or two containers with the first container.

Additional background information can be found in the present inventor's two copending United States patent applications, Ser. No. 560,597 entitled "Mated Container Units", filed on Dec. 12, 1983 (now U.S. Pat. No. 4,573,595), and Ser. No. 577,177, entitled "Multiple Container Package", filed Feb. 6, 1984 (now U.S. Pat. No. 4,570,799), and the entire subject matter of these two applications is incorporated herein by reference.

SUMMARY OF THE INVENTION

The present invention is directed to a container package that is composed of a plurality of mated and interlocked containers which together substantially fill a polyhedral volume. Each container has a body with four preferably polygonal lateral side walls, a polygonal bottom wall and a top shoulder wall. A neck extends upwardly from the shoulder wall and is integrally formed as one piece with the body. The combined inner volume of the body and neck form the total interior volume of the container. Each container body has, either in its base or one of its lateral side walls, a recess which is shaped to receive a neck of an adjacent container in the package. In this way, one container is mated and engaged with the next. Two, three, or four containers can be connected by engagement of the necks and recesses to form a polyhedral volume in which virtually no space is wasted.

In accordance with a feature of the invention, the containers have either different interior volumes or different exterior displacements. Interior volumes having different amounts of the same or different materials can be supplied in a single package configuration. Such a configuration is particularly useful in fields where two or more chemicals or substances are used in conjunction with each other. Where different amounts of the different substances must be combined together, the exact proportions can be distributed among the plural containers in the inventive package.

It is also useful to provide a package having containers in which each container has the same or a similar interior volume but which define different exterior volumes or displacements. In such a case, the wall thickness of some containers in the package are different from the wall thickness of other containers of the package. Such a package is advantageous where different materials to be stored in a package have different storage characteristics. A container for a pressurized, carbonated liquid, for example, may require thicker walls than a container for a non-carbonated liquid or a powder.

Similarly, all containers of the package may have identical interior volumes but different exterior shapes. For example, one unit may have a short neck with a large diameter or cross-section while another unit may have a neck with a smaller diameter or cross-section. The length and shape of the necks could be different to assist in identifying contents that differ.

Thus, an advantageous feature of certain embodiments of the invention is that the difference of outward appearance of the containers in the package can be used to identify their contents.

Accordingly, the present invention provides a multiple container package which comprises a plurality of mated hollow containers each having an interior volume and an exterior volume, each container being made of a hollow body and a hollow neck integrally connected to the hollow body. The hollow body comprises side walls, a rear wall, a front wall, a bottom wall and a top shoulder wall which may all be polygonal in shape. The neck extends outwardly of the body from the top shoulder wall. A recess is provided either in the bottom wall or in the front wall of the hollow body with a neck of one container extending partly or fully into the recess of an adjacent container. At least two walls of two adjacent containers lie in contiguous relationship against each other so that the mated containers form a polyhedron which is substantially filled by the containers. Either the interior volumes or the exterior volumes or shapes of at least two containers in the package are different from each other.

According to another feature of the invention, one or more of the necks of one container is foreshortened so as to leave a remaining space in the respective recess of the other container in which the neck is received. One or more secondary containers are provided in this remaining space and substantially fill the remaining space.

An object achieved by the invention is the provision of a multiple container package which includes containers having different interior volumes or for containing different substances which are used in conjunction with each other and in the predetermined portions provided in the various containers of the package.

A further object of the invention is the provision of a multiple container package which substantially occupies and fills the minimum rectangular polyhedral volume of one container, where two containers are provided in the package, or substantially fill the volume occupied by the minimum rectangular polyhedral volume of two containers, where three or four containers are provided in the package.

An even further object of the invention is the provision of a container package which best fits rectangular spaces of conventional cartons or boxes normally utilized for transporting packages.

An even still further object of the invention is the provision of a multiple container package which is simple in design, rugged in construction and economical to manufacture.

The various features of novelty which characterize the invention are pointed out with particularity in the claims annexed to and forming a part of this specification. For a better understanding of this invention, its operating advantages and the specific objects obtained by its use, reference should be had to the accompanying drawings and descriptive matter in which there are illustrated preferred embodiments of the invention.

BRIEF DESCRIPTION OF THE DRAWINGS

In the drawings, forming a part of this specification, and in which reference numerals shown in the drawings designate like or corresponding parts throughout.

DESCRIPTION OF THE PREFERRED EMBODIMENTS

Figure 1:
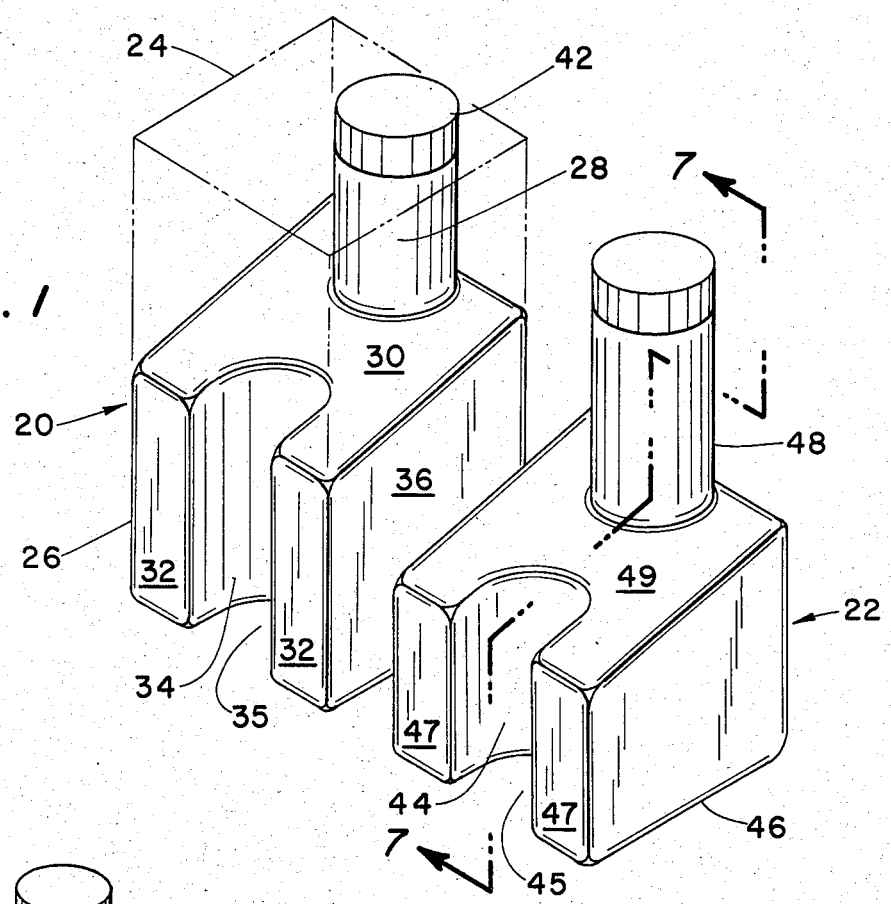
FIG. 1 is a top front perspective view of two containers which can be mated together to form a multiple container package, shown in their unmated state.

Referring to the drawings in particular, the invention embodied therein comprises a multiple container package which includes two or more containers that have either different interior or exterior volumes or both, or two or more containers of like interior and exterior volumes but which have different shapes. When the containers are mated together, they form a polyhedron.

Figure 3:
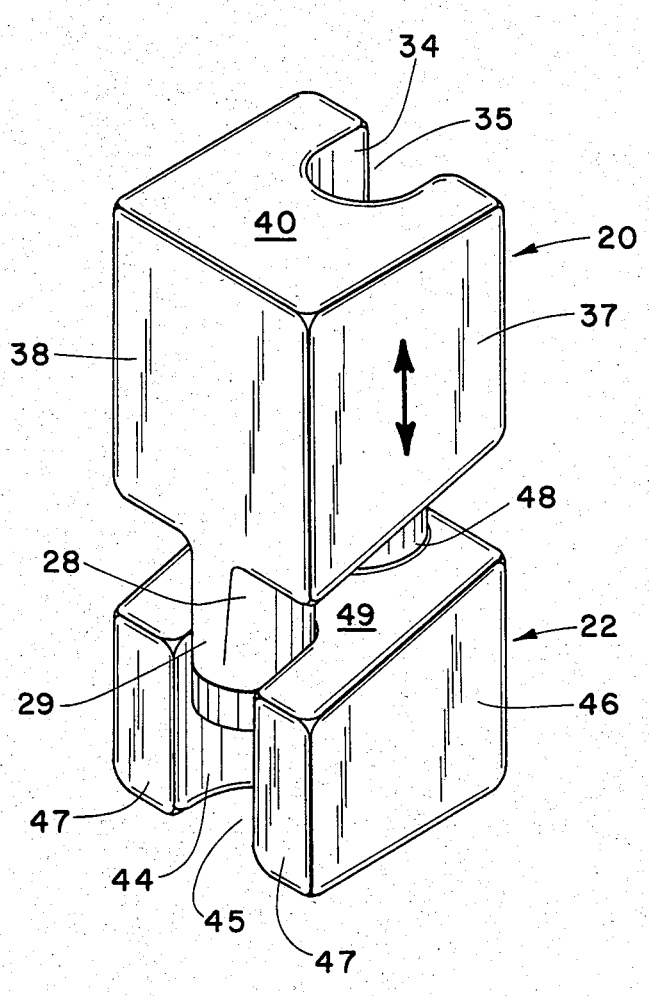
FIG. 3 is a partly-exploded front top perspective view of the containers of FIG. 1 shown as they are about to be fully mated to each other.
Figure 5:
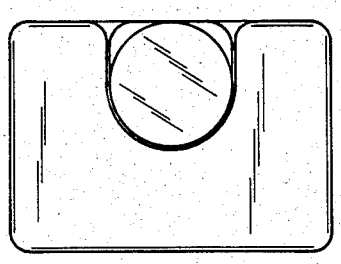
FIG. 5 is a view similar to FIG. 4 of another embodiment of the invention wherein the containers have a rectangular cross section rather than a square cross section.
Figure 6:
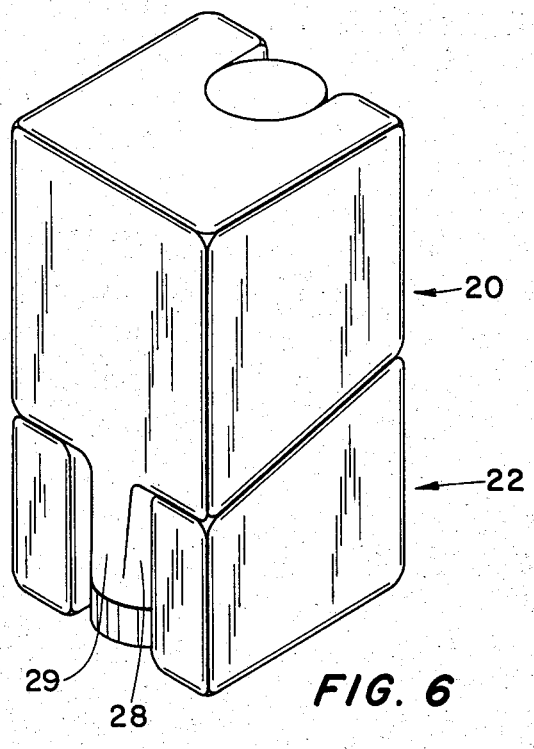
FIG. 6 is a top front perspective view of the containers which illustrates the containers of FIG. 1 fully mated to each other.

FIG. 1 shows two containers 20 and 22 which can be mated to each other in the configuration shown in FIGS. 3 and 6. The mated containers substantially fill the minimum rectangular polyhedral volume or envelope required to encompass one of the containers. As shown in FIG. 1, by phantom lines at 24, the two mated containers will substantially fill and occupy the minimum polyhedron which can be drawn about and encompass a single one of the containers.

Container 20 comprises a body 26 and a neck 28 extending upwardly from a top shoulder wall 30 of body 26. Body 26 includes a front wall 32 having an arcuate recessed surface 34 therein which in the illustrated embodiment is U-shaped or semi-circular. The recessed surface could extend for more than 180 degrees to form a lip which prevents lateral movement of the neck of a mated container inserted into the recess. Recess 35 is elongated and may be slightly tapered in the downward direction. Body 26 also includes side walls 36 and 37, a rear wall 38 (see FIG. 3) and a bottom wall 40 which is opposite, but in the illustrated embodiment not parallel to, the shoulder wall 30.

Recess 35, in the embodiment of FIGS. 1 and 3, has opposite open ends which open respectively into the shoulder wall 30 and bottom wall 40, and is further open at front wall 32. Recess 35 may however be closed at front wall 32 and also at bottom wall 40.

Body 26 and neck 28 are both hollow and together define the interior volume of container 20. Neck 28 has an open top which can be closed by a threaded cap 42 or other closure means. The neck 28 preferably has a generally circular front and side surface and a planar rear surface 29.

Container 22 also includes a hollow body 46 and a hollow neck 48. Body 46 has a front wall 47 with a U-shaped recessed surface 44, which represents a peripheral surface for recess 45, a top shoulder wall 49, side walls, a rear wall and a bottom wall. Each of the walls of the body 46, like those of the body 26, are polygonal.

As shown in FIG. 3, containers 20 and 22 are mated together by inserting neck 28 of container 20 into recess 45 of container 22 and, neck 48 of container 22 into recess 35 of container 20. When the containers are fully mated with each other, as shown in FIG. 6, their shoulder walls 30, 49 lie contiguously with respect to each other and against each other. The length of neck 28 of container 20 is essentially equal to the length of the recess 45 of container 22 and, correspondingly, the length of neck 48 of container 22 is essentially equal to the length of recess 35 of container 20. The volume thus occupied by containers 20 and 22, when they are mated together, corresponds exactly to the minimum rectangular polyhedral volume 24 needed to encompass the neck (including the closure) of a single one of the containers. The exposed surfaces of the respective side walls, rear walls and front walls and rear surfaces of the necks of the two containers provide a substantially uninterrupted surface contour on the so assembled container package.

Figure 4:
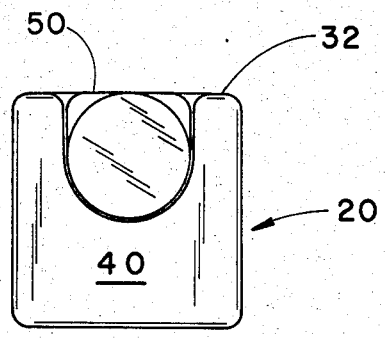
FIG. 4 is top plan view of the containers of FIG. 1 shown in their fully mated state.

As is best shown in FIGS. 3 and 4, the neck 48 of container 22 also includes a planar rear surface 50 which aligns as a substantially uninterrupted surface with the front wall 32 of container 20 so that the surface 50, front wall 32 and rear wall of container 22 are essentially flush. Similarly, the neck 28 substantially fills the recess 45 of container 22 so that rear face 29 of the neck 28 of container 20 extends substantially in a plane which contains the front wall 47 of container 22 in FIG. 4.

Figure 2:
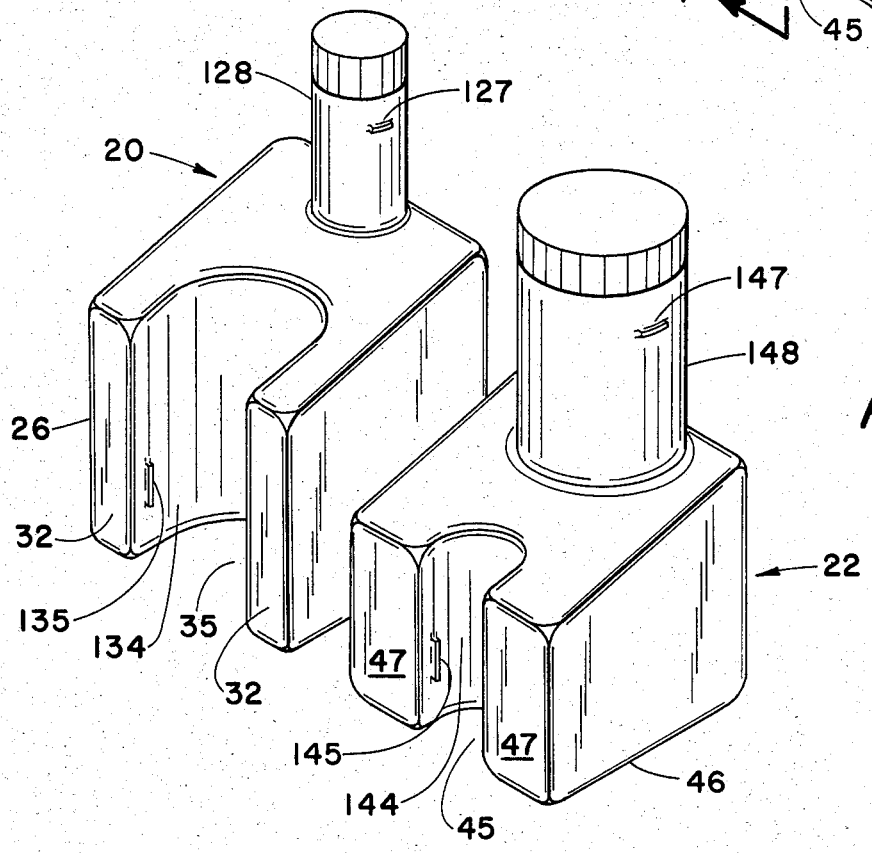
FIG. 2 is a view, similar to FIG. 1, showing containers formed in accordance with another embodiment of the invention.

FIG. 2 shows an alternate embodiment of the invention wherein the interior volumes of containers 20 and 22 are identical. This is accomplished by providing container 22 with a neck 148 having a larger diameter than the neck 128 of container 20 and correspondingly shaped recessed surfaces 134 and 144.

By way of illustration, in the embodiment of FIG. 2, longitudinal ribs 135 and 145 are formed on opposite sides of the recessed surfaces 134, 144 and radial ribs 127, 147 are formed on the necks 128, 148 respectively. When the containers 20, 22 of the embodiment of FIG. 2 are mated, the longitudinal ribs engage the back of the necks which are received in the recesses and restrain lateral movement of the container. The radial ribs engage the bottom ends longitudinal recesses to restrict unintended longitudinal movement of the containers. When the containers are comprised of plastic, enough flexibility is provided to allow transverse or lateral separation upon the application of positive pressure.

Containers 20 and 22, in the embodiment of FIG. 2, differ in that they have different interior and different exterior shapes. As shown, container 22 has a shorter body 46 and a longer neck 148 than the respective body 26 and neck 128 of container 20.

The exterior volume of each container 20, 22 of the embodiment of FIG. 2 comprises its outer displacement. The difference between the interior and the exterior volumes of each container represents the wall thickness for the containers.

Figure 7:
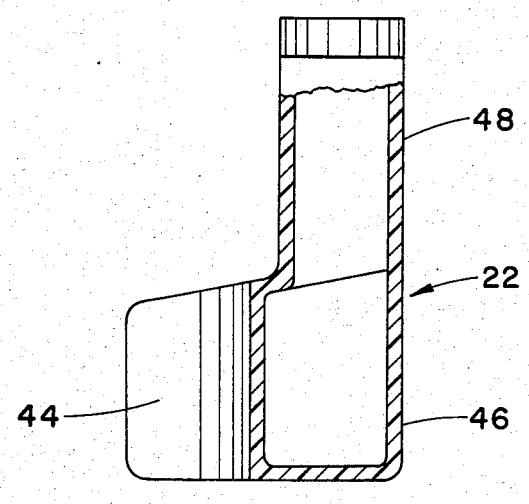
FIG. 7 is a view, partly in section, taken along view line 7—7 of FIG. 1.
Figure 8:
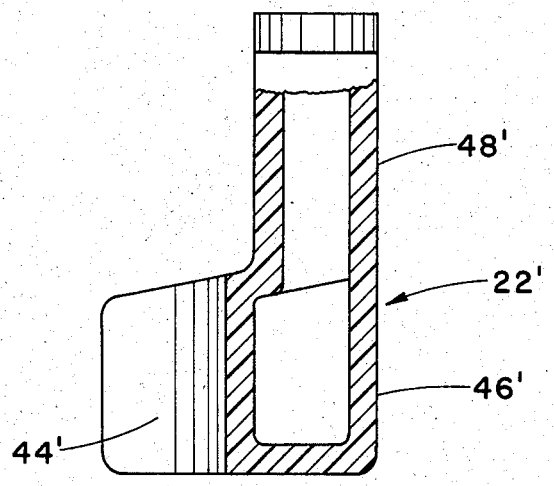
FIG. 8 is a view, similar to the view of FIG. 7, showing still another form of the containers according to the invention, having the same exterior volume as in FIG. 7 but with thicker side walls so that it includes a smaller interior volume.

FIG. 7 illustrates a sectional view of container 22 wherein the body 46 and neck 48 are made of relatively thin-walled material. By way of comparison, FIG. 8 shows a container 22′ having an identical exterior volume or displacement as container 22 of FIG. 1, but a smaller interior volume due to the fact that the container of FIG. 8 has thicker side walls. Container 22′ also includes a hollow body 46′ having a recessed surface 44′ and with a neck 48′ extending upwardly from the body.

A modification of the invention is shown in FIGS. 9–12.

Figure 9:
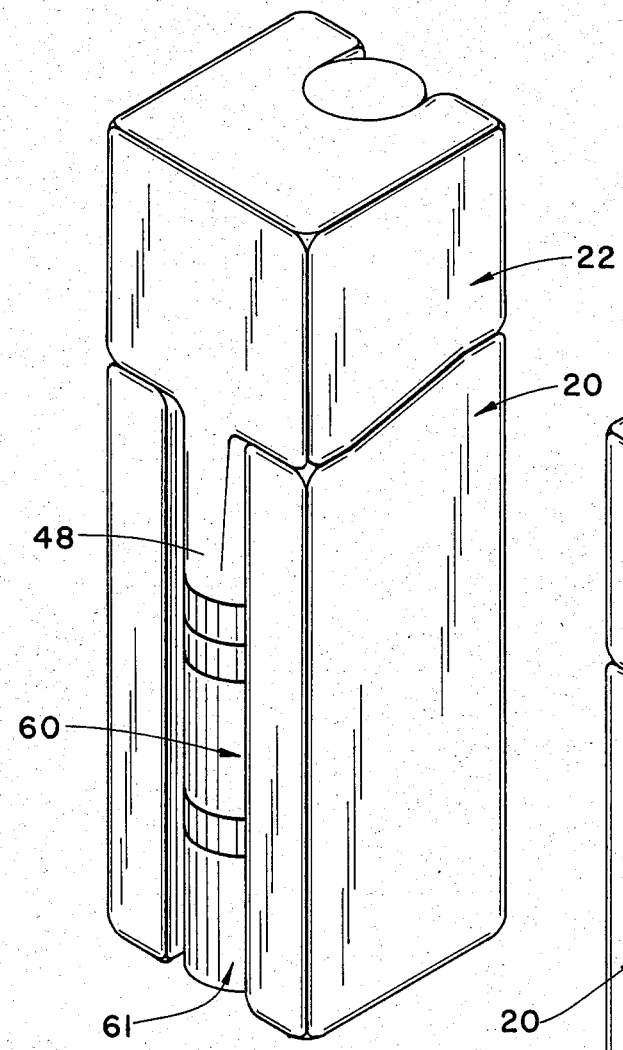
FIG. 9 is a top perspective view of a container package including two primary containers and two secondary containers which occupy part of the space of one of the container recesses.

In FIG. 9, the neck 48 of container 22 is shortened so that it occupies only part of the space for the recess 35 in container 20. The remainder of the space is occupied and substantially filled by secondary containers 60, 61 which substantially have the same shape as the portion of neck 48 which has been removed. In this way, four containers are interlocked and mated with each other, containers 60 and 61 have a far smaller capacity than either containers 20 or 22. This configuration is particularly advantageous where multiple chemicals or substances must be mixed together, one or two of the substances being needed in a far smaller volume than the other substances. This container would be particularly useful in the field of adhesives which for example utilize large volumes of resin which is cured and hardened by a relatively small volume of hardening agent.

Figure 10:
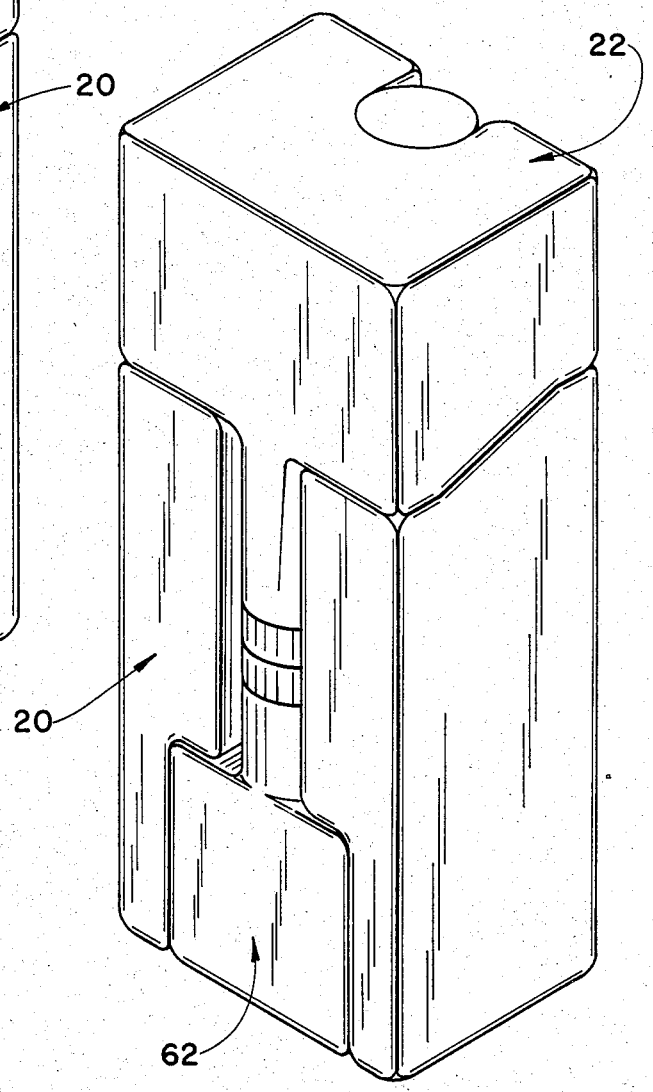
FIG. 10 is a view similar to FIG. 9 showing an embodiment of a three container package.

FIG. 10 shows another embodiment of a three container package wherein the recess of container 20 has been enlarged for receiving a correspondingly larger secondary container 62.

Figure 11:
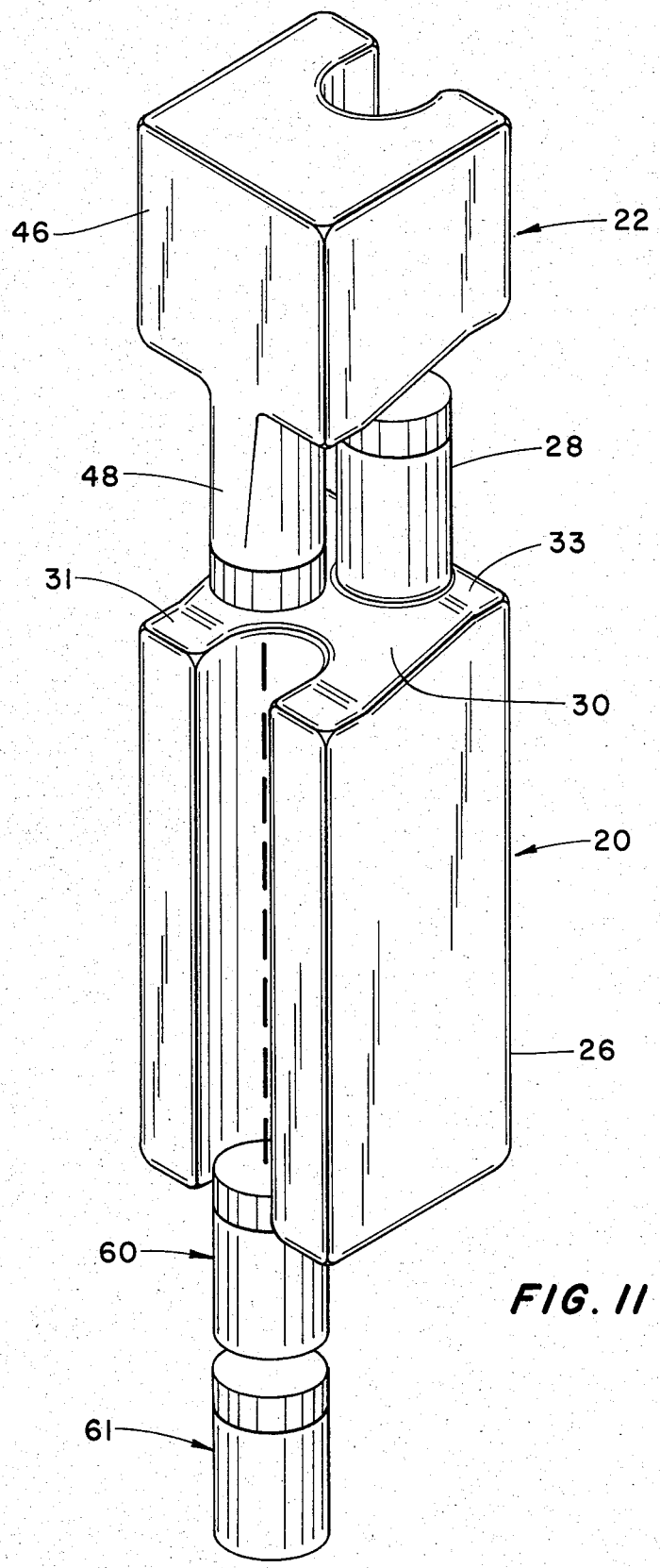
FIG. 11 is an exploded perspective view of the embodiment of FIG. 9.
Figure 12:
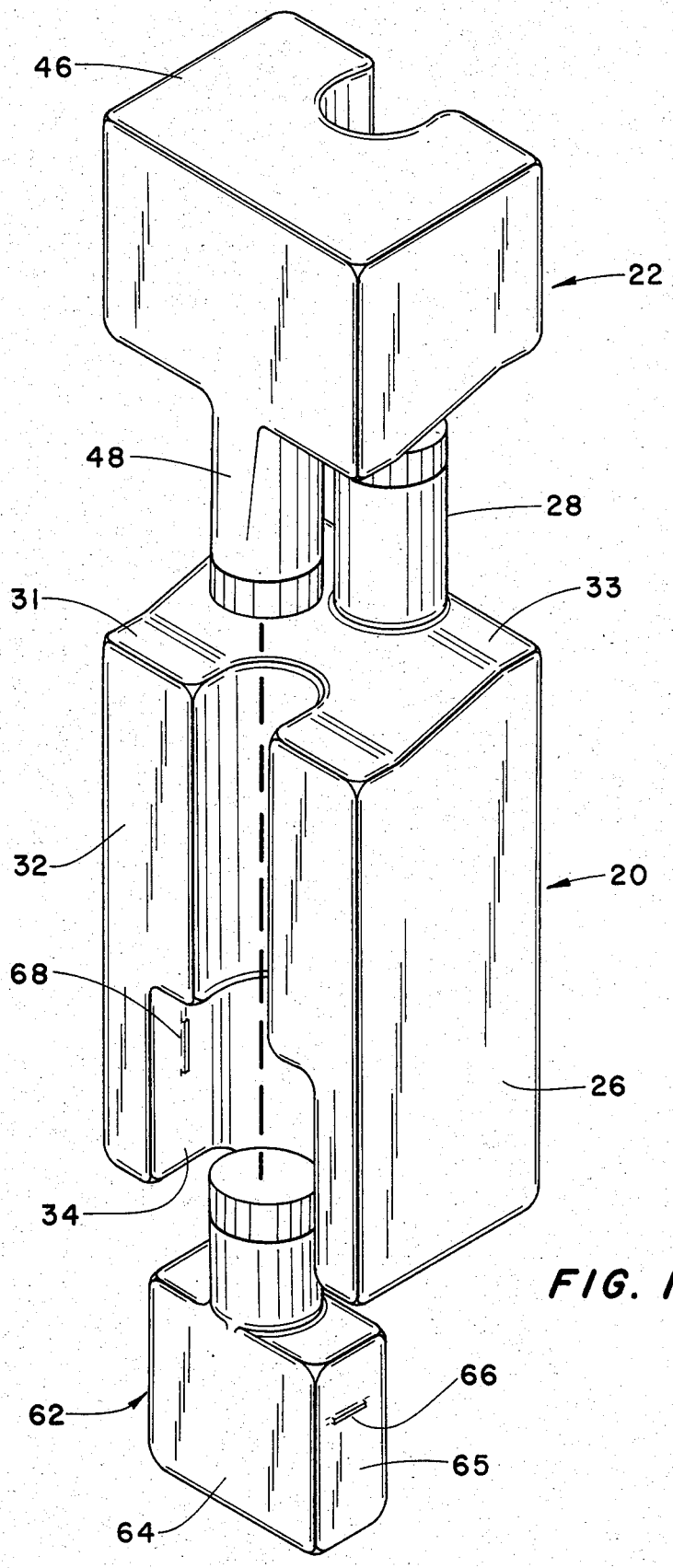
FIG. 12 is an exploded perspective view of the embodiment of FIG. 10.

The exploded views of FIGS. 11 and 12 illustrated further details of the embodiments of FIGS. 9 and 10, respectively. In the embodiments of FIGS. 11 and 12, the top shoulder wall 30 of container 20 and the corresponding top shoulder wall (not shown) of container 22 are stepped so that portions 31, 33 are parallel to the bottom wall.

As shown in FIG. 12, secondary container 62 includes a flat rear wall 64 which extends to a plane containing the front wall 32 of container 20. In this way the polyhedral shape of the container package is maintained. Each of the side walls 65 of secondary container 62, only one of which is shown, includes a horizontal rib 66 that is designed to engage the upper end of vertical ribs 88 (only one of which is shown) formed on the recessed surface 34 of container 20. The vertical rib 68 also acts to restrict lateral movement of the container 62.

The recessed surfaces that surround recesses for the containers may be shaped so that they embrace their respective necks by more than 180 degrees of arc. In this way once the containers are mated together into a package, they cannot be disengaged by lateral movement, but only by longitudinal movement in the direction of the double arrow shown in FIG. 3. Alternate means, such as projections formed on the recessed surfaces that surround the recesses can also be employed to prevent or restrain lateral movement. The containers are preferably made of a plastic which has a certain resiliency which will allow the neck to engage and be disengaged from such projections.

More than two containers can be mated together into a single polyhedral package as shown in FIGS. 13–16.

Figure 13:
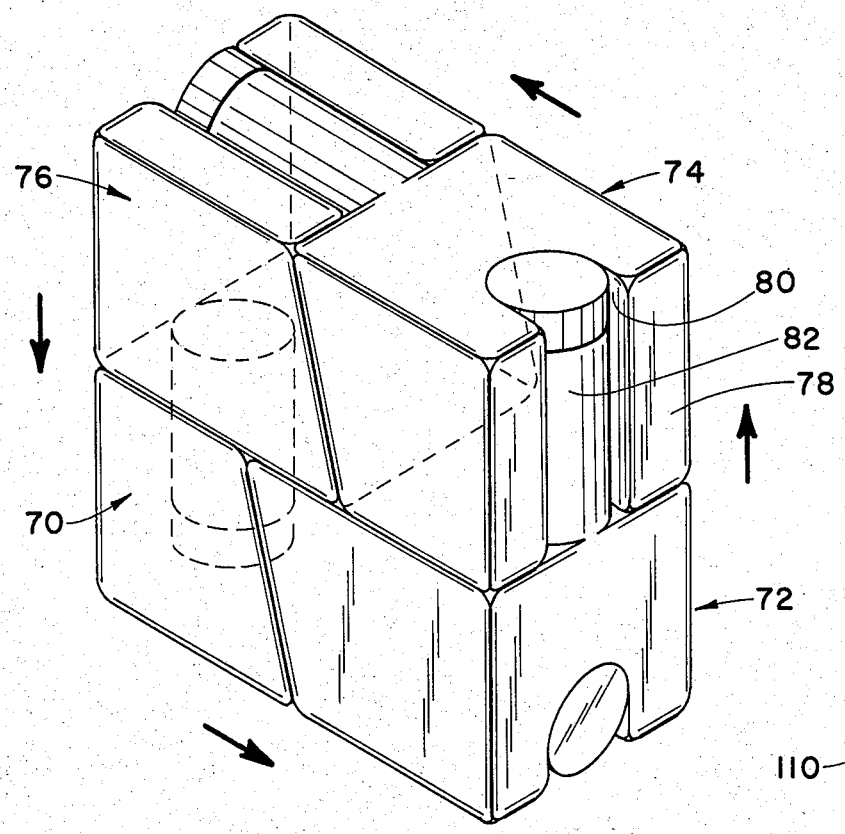
FIG. 13 is a perspective view of a further embodiment of the invention including four container packages.

In FIG. 13, four containers 70, 72, 74, and 76 are mated together by sliding them in the direction of the arrows. Each container has a bottom wall with a recess for receiving the neck of an adjacent container. Container 74 for example, has bottom wall 78 with recess 80 which receives neck 82 of container 72. Two or more of the containers can be provided with different interior or exterior volumes. In FIG. 13, for example, containers 70 and 74 have identical configurations and can be made using identical molds. Containers 76 and 72 are identical to each other but have larger interior and exterior volume than do containers 74 and 70. It is also noted that while containers 70 and 74 have top shoulder walls which incline downwardly from a respective rear wall to a respective front wall, the shoulder walls of containers 72 and 76 (which are not visible in FIG. 13) extend perpendicularly to the rear wall of each of those containers. This is to insure that when the containers are mated together they form a true polyhedron.

Figure 14:
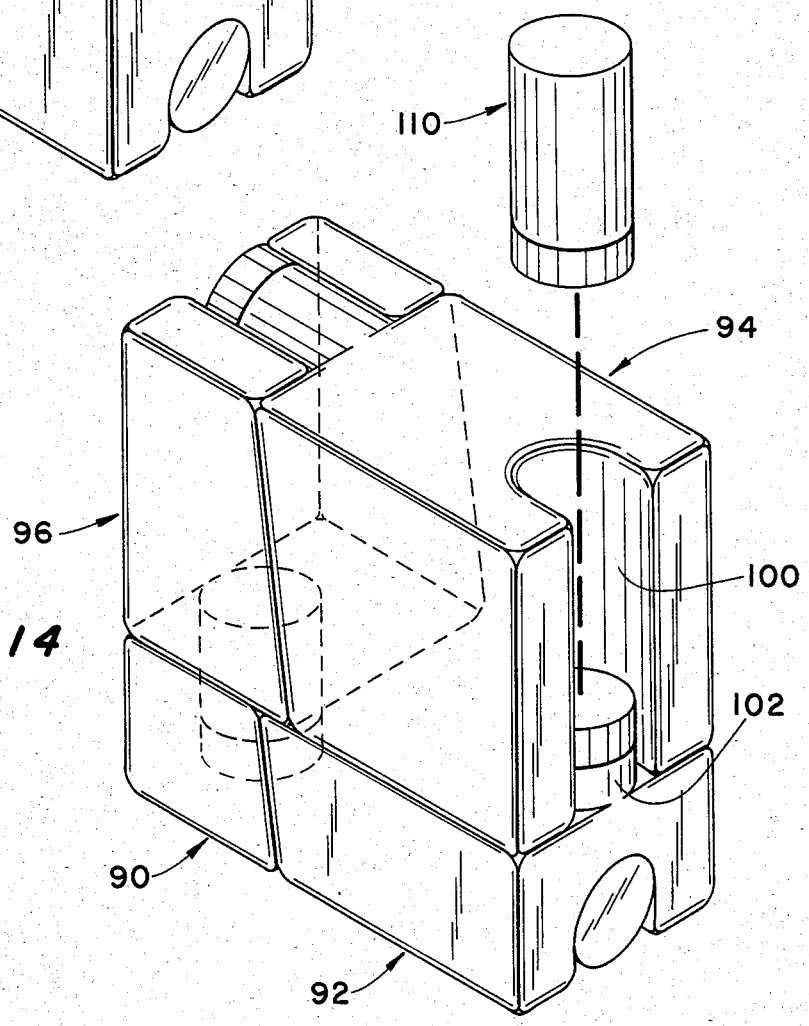
FIG. 14 is a partially-exploded perspective view, similar to FIG. 13, of even still another embodiment of the invention which includes a fifth container occupying some of the space of one of the container recesses.

FIG. 14 shows a modified embodiment wherein containers 90 and 92 have volumes which are different from each other and which are both smaller than the volumes of containers 94 and 96. Neck 102 of container 92 is shortened and the remaining space in recess 100 of container 94 is occupied by a secondary container 110 which is shaped similarly to container 60 of FIGS. 9 and 11.

Figure 15:
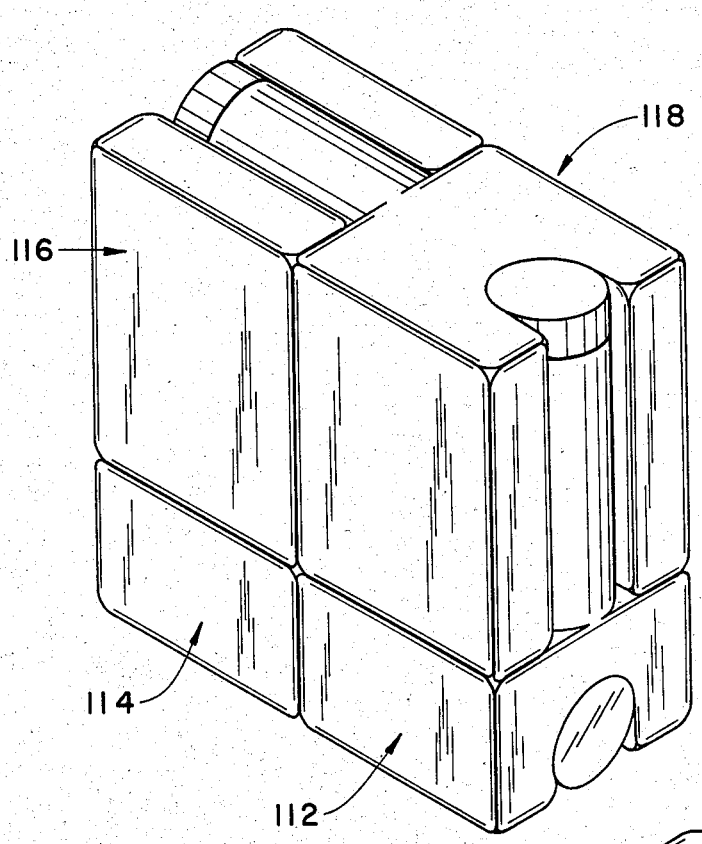
FIG. 15 is a view similar to FIG. 13 of a further embodiment of the invention.

FIG. 15 shows a package of four containers, 112, 114, 116, 118, which all have walls that lie at ninety degrees with respect to each other. Secondary containers could be accommodated by foreshortening one or more of the necks and configuring the recessed surface accordingly.

Figure 16:
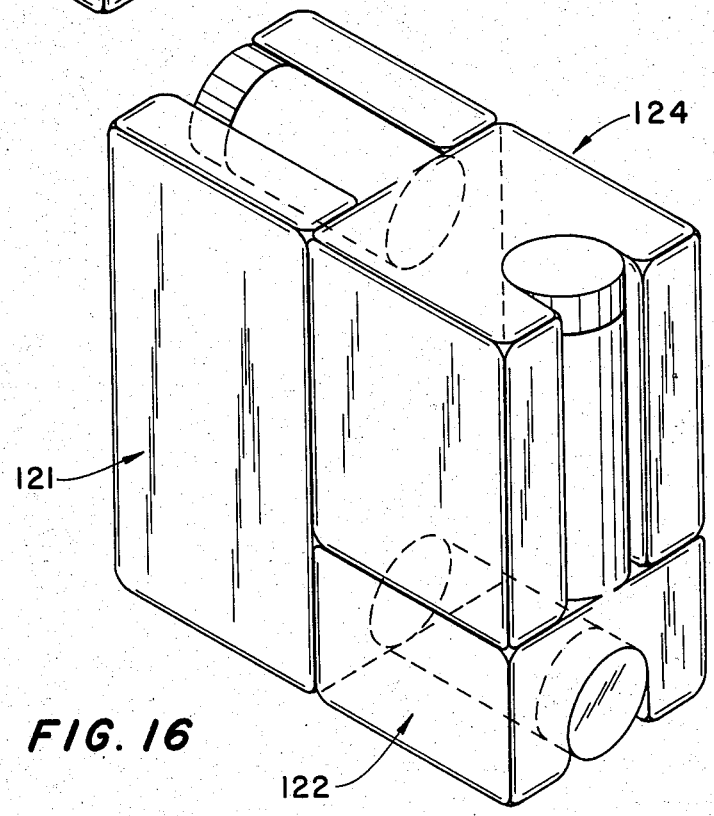
FIG. 16 is a view similar to FIG. 13 showing a still further embodiment of the invention wherein three mated containers are included in the package.

FIG. 16 shows an embodiment of the invention with perpendicular walls as in embodiment of FIG. 15. In the embodiment of FIG. 16 however, three containers are mated together. Container 121 extends along one full side of the polyhedron which is filled by the remaining containers 122 and 124.

In the embodiments of FIGS. 13–16, the package includes containers which fill the minimum polyhedral volume of two of the containers. This assumes however that the two containers that are utilized to define this volume do not have shortened necks as in the embodiment of FIG. 14.

In all the embodiments of the invention, each of the primary containers, that is excluding the secondary containers such as containers 60 and 100, have two side walls, with one side wall of every container in the package laying in one side plane of the polyhedron which is filled by the package, the other side wall laying in an opposite side plane of the polyhedron.

While all the embodiments shown comprise container packages which fill a rectangular polyhedron, the invention is not limited to such polyhedrons and may also form parallelepipeds, hexahedrons, tetrahedrons or other polyhedrons having sides which do not meet at ninety degrees.

The recesses and corresponding necks are also shown as being substantially cylindrical. The recesses and necks may, however, be rectangular or square in cross section or have any other polygonal shape.

Variable container packages, according to the invention, preferably utilize containers molded or shaped from a thermoplastic such as polyethylene, polyethylene terethalate, polyprophylene, polyvinyl chloride, or the like and produced by process such as injection blow molding, extrusion blow molding, stretch blow molding, extrusion stretch blow molding, or monolayer or multi-layer techniques.

While specific embodiments of the invention have been shown and described in detail to illustrate the application of the principles of the invention, it will be understood that the invention may be embodied otherwise without departing from such principles.

The embodiments of the invention in which an exclusive property or priviledge is claimed are defined as follows:

1. A multiple container package comprising a plurality of mated containers each having an interior volume and an exterior volume, each container having a hollow body including two polygonal side walls, a polygonal rear wall, a polygonal front wall, a polygonal bottom wall and a top shoulder wall, with an elongated recessed surface adjacent one of said bottom and front walls forming a recess in each container, each recess in a bottom of a container extending through the rear and front walls of that container and each recess in a front wall of a container extending through the shoulder and bottom of that container, each container having a hollow neck connected integrally to said body and extending outwardly from said top shoulder wall into the recess of the recessed surface of another container, at least one wall of adjacent container bodies lying in contiguous relationship against each other, said plurality of containers forming a polyhedron having opposite side planes with one side wall of each container body lying in one side plane and the other side wall of each container body lying in the other side plane, one of the interior and exterior volumes of at least two of said plurality of containers being different from each other, said polyhedron being the minimum rectangular polyhedron which is needed to encompass at least one of said containers with its hollow body and neck, said at least one container having a neck which substantially fills the recess of another one of said containers.

2. A multiple container package according to claim 1 including a secondary container disposed in said recess of one of said containers, said secondary container plus a neck of another container substantially filling said recess.

3. A multiple container package according to claim 2 wherein said recessed surface of said one container has enlarged recess portion for containing said secondary container and a recess portion for receiving said neck of the other container.

4. A multiple container package according to claim 1 including two containers, shoulder walls of said containers lying contiguously to each other and each container body having its recess defined in its front wall.

5. A multiple container package according to claim 4 wherein said recessed surface is open at said front wall of its body, said recess having open opposite ends at said shoulder and bottom walls of its body.

6. A multiple container package according to claim 5 wherein said two containers have necks of different lengths.

7. A multiple container package according to claim 6 wherein each of the containers comprise cylindrical necks having different diameters.

8. A multiple container package according to claim 1 wherein said interior volume of said two containers is different from each other.

9. A multiple container package according to claim 8 wherein said shoulder wall of each container is inclined downwardly from said front wall to said rear wall, said recess extending centrally in said front wall for each container.

10. A multiple container package according to claim 9 including at least one secondary container disposed in one recess, said one recess being substantially filled by said secondary container plus the neck of the other container.

11. A multiple container package according to claim 1 wherein said neck of each container has a flat portion which is substantially coplanar with the rear wall of its container body, and substantially coplanar with a front wall of a container into which said neck extends.

12. A multiple container package according to claim 2 wherein said secondary container comprises a plurality of secondary containers.

13. A multiple container package according to claim 1 wherein said polyhedron includes planar faces substantially filled with the side walls, the polygonal rear wall, the polygonal front wall and the polygonal bottom wall of the plurality of containers.

14. A multiple container package comprising a plurality of mated containers each having an interior volume and an exterior volume, each container having a hollow body including two polygonal side walls, a polygonal rear wall, a polygonal front wall, a polygonal bottom wall and a top shoulder wall, with an elongated recessed surface adjacent one of said bottom and front walls, and each container having a hollow neck connected integrally to said body and extending outwardly from said top shoulder wall into the recess of the recessed surface of another container, at least one wall of adjacent container bodies lying in contiguous relationship against each other, said plurality of containers forming a polyhedron having opposite side planes with one side wall of each container body lying in one side plane and the other side wall of each container body lying in the other side plane, one of the interior and exterior volumes of at least two of said plurality of containers being different from each other, there being at least four containers with said recess for each container body being defined in said bottom wall of each container body and each container body having a shoulder wall which is contiguous with and lies against a front wall of an adjacent container body, each recess of each container body being open at its adjacent bottom wall, each recess having open opposite ends in said rear wall and front wall respectively.

15. A multiple container package according to claim 14 wherein necks of adjacent containers in said package have different lengths.

16. A multiple container package according to claim 15 wherein at least two of said four containers have different interior volumes.

17. A multiple container package according to claim 14 wherein said neck of each container has a flat portion which is substantially coplanar with the rear wall of its container body, and substantially coplanar with a bottom wall of a container into which said neck extends.

18. A multiple container package according to claim 14 wherein said polyhedron includes planar faces substantially filled with the side walls, the polygonal rear wall, the polygonal front wall and the polygonal bottom wall of the plurality of containers.

19. A multiple container package comprising a plurality of mated containers each having an interior volume and an exterior volume, each container having a hollow body including two polygonal side walls, a polygonal rear wall, a polygonal front wall, a polygonal bottom wall and a top shoulder wall, with an elongated recessed surface adjacent one of said bottom and front walls, and each container having a hollow neck connected integrally to said body and extending outwardly from said top shoulder wall into the recess of the recessed surface of another container, at least one wall of adjacent container bodies lying in contiguous relationship against each other, said plurality of containers forming a polyhedron having opposite side planes with one side wall of each container body lying in one side plane and the other side wall of each container body lying in the other side plane, one of the interior and exterior volumes of at least two of said plurality of containers being different from each other and wherein said neck of each container has a flat portion which is substantially coplanar with the rear wall of its container body, and substantially coplanar with a front wall of a container into which said neck extends, and a secondary container in at least one recess, said secondary container and the neck from another container extending into said recess and substantially filling said one recess.

20. A multiple container package according to claim 19 wherein said polyhedron includes planar faces substantially filled with the side walls, the polygonal rear wall, the polygonal front wall and the polygonal bottom wall of the plurality of containers.

21. A multiple container package comprising:

a first container defining a hollow interior space and having an outer displacement, said first container formed of a body having four lateral walls, a bottom wall and a top wall, and a neck extending outwardly from said top wall near one of said lateral walls, one of said lateral walls having an elongated recess therein extending substantially parallel to said neck and being spaced laterally from said neck; a second container defining a hollow interior space and having an outer displacement, said second container formed of a body having four lateral walls, a bottom wall, and a top wall, and a neck extending outwardly from said top wall near one of said lateral walls, one of said lateral walls having an elongated recess therein extending substantially parallel to said neck and being spaced laterally of said one lateral wall; said neck of said first container extending into said recess of said second container and said neck of said second container extending into said recess of said first container with said top walls of said first and second containers laying contiguously and against each other, said first and second containers together defining a polyhedron with a volume corresponding to the greater minimum rectangular polyhedral volume of one of said first and second container; said interior volumes of said first and second containers being different from each other; further comprising a secondary container; and wherein said recess of each container being open at at least one of said lateral walls of that container and being open at said bottom wall and at said top wall of that container; said one of said first and second containers which has a minimum rectangular polyhedral volume corresponding to the polyhedron defined by said first and second containers, having said secondary container in its recess, said recess of said at least one container being substantially filled by said secondary container and by said neck of the other container.

22. A multiple container package according to claim 21 wherein said secondary container comprises an outer surface and said polyhedron includes planar faces substantially filled with the lateral walls and bottom wall of each of the first and second containers and said outer surface of the secondary container.

* * * * *